US012022887B2

(12) United States Patent
Testoni et al.

(10) Patent No.: US 12,022,887 B2
(45) Date of Patent: Jul. 2, 2024

(54) APPARATUS AND METHOD FOR CARRYING OUT OPERATIONS ON SEMI-FINISHED DEVICES, IN PARTICULAR FOR PRODUCING DISPOSABLE CARTRIDGES FOR ELECTRONIC CIGARETTES

(71) Applicant: G.D S.p.A., Bologna (IT)

(72) Inventors: Luca Testoni, Bologna (IT); Fabio Fini, Bologna (IT); Antonio Lanzarini, Bologna (IT); Luca Lanzarini, Bologna (IT); Luca Federici, Bologna (IT)

(73) Assignee: G.D S.p.A., Bologna (IT)

( * ) Notice: Subject to any disclaimer, the term of this patent is extended or adjusted under 35 U.S.C. 154(b) by 723 days.

(21) Appl. No.: 17/282,413

(22) PCT Filed: Sep. 19, 2019

(86) PCT No.: PCT/IB2019/057922
§ 371 (c)(1),
(2) Date: Apr. 2, 2021

(87) PCT Pub. No.: WO2020/070573
PCT Pub. Date: Apr. 9, 2020

(65) Prior Publication Data

US 2021/0378317 A1 Dec. 9, 2021

(30) Foreign Application Priority Data

Oct. 5, 2018 (IT) ..... 102018000009193

(51) Int. Cl.
*B65G 54/02* (2006.01)
*A24F 40/10* (2020.01)
(Continued)

(52) U.S. Cl.
CPC ..... *A24F 40/70* (2020.01); *A24F 40/10* (2020.01); *A24F 40/42* (2020.01); *B65B 3/04* (2013.01);
(Continued)

(58) Field of Classification Search
CPC ..... A24F 40/70; A24F 40/10; A24F 40/42; B65B 3/04; B65B 43/42; B65B 43/54; B65B 65/003; B60L 5/06; B65G 54/02
(Continued)

(56) References Cited

U.S. PATENT DOCUMENTS 5,971,041 A * 10/1999 Drewitz ..... B67C 3/04 141/180
9,745,146 B2 * 8/2017 Schaeuble ..... B65G 43/10
(Continued)

FOREIGN PATENT DOCUMENTS

DE 102015226141 A1 6/2017
WO 2018078565 A1 5/2018

OTHER PUBLICATIONS

International Search Report and Written Opinion dated Dec. 11, 2019. 14 pages.

*Primary Examiner* — Douglas A Hess
(74) *Attorney, Agent, or Firm* — RMCK Law Group PLC

(57) ABSTRACT

Apparatus for performing operations on semi-finished devices for producing disposable cartridges for electronic cigarettes includes: a guide having a branch extending along a forming direction, and having a longitudinal plane; carriages movable along the guide, each guide includes a retaining element to retain a semi-finished device during operations thereon; a drive system for advancing the carriages along the guide; and operating stations spaced from each other along the forming direction, each having an operating arrangement for performing operations on the
(Continued)

semi-finished devices carried by the retaining elements applying stresses on the semi-finished devices; wherein: the retaining element is arranged laterally relative to the longitudinal plane, the apparatus includes a stationary support located at the operating stations, and each of the carriages includes a contrast element cooperating with the stationary support and arranged to transfer stresses applied by the operating arrangement on the semi-finished devices to the stationary support.

14 Claims, 4 Drawing Sheets

(51) Int. Cl.

| | |
|---|---|
| ***A24F 40/42*** | (2020.01) |
| ***A24F 40/70*** | (2020.01) |
| ***B65B 3/04*** | (2006.01) |
| ***B65B 43/42*** | (2006.01) |
| ***B65B 43/54*** | (2006.01) |
| ***B65B 65/00*** | (2006.01) |

(52) U.S. Cl.
CPC ..... *B65B 43/42* (2013.01); *B65B 43/54* (2013.01); *B65B 65/003* (2013.01)

(58) Field of Classification Search
USPC ..... 198/345.1, 690.1, 619
See application file for complete search history.

(56) References Cited

U.S. PATENT DOCUMENTS

| | | | | |
|---|---|---|---|---|
| 10,440,989 | B2 * | 10/2019 | Gardella | B65B 39/12 |
| 10,608,469 | B2 * | 3/2020 | Floresta | H02J 50/30 |
| 10,894,675 | B2 * | 1/2021 | Hartung | B65G 54/02 |
| 11,089,819 | B2 * | 8/2021 | Testoni | B65G 54/02 |
| 11,166,490 | B2 * | 11/2021 | Gardella | B65B 29/00 |
| 11,198,564 | B2 * | 12/2021 | Monti | F16C 29/045 |
| 11,309,737 | B2 * | 4/2022 | Floresta | H02P 6/04 |
| 11,377,311 | B2 * | 7/2022 | Elsperger | H02K 41/031 |
| 11,548,740 | B2 * | 1/2023 | Lasserre | B65G 54/02 |
| 11,641,884 | B2 * | 5/2023 | Testoni | B61B 13/12 198/619 |
| 11,708,226 | B2 * | 7/2023 | Neubauer | B67C 3/24 198/617 |
| 11,715,977 | B2 * | 8/2023 | Floresta | B60L 5/005 318/5 |
| 11,772,907 | B2 * | 10/2023 | Testoni | B65B 65/003 198/537 |
| 11,787,645 | B2 * | 10/2023 | Solà | B65B 43/32 198/468.2 |
| 2015/0223522 | A1 | 8/2015 | Ampolini et al. | |

* cited by examiner

APPARATUS AND METHOD FOR CARRYING OUT OPERATIONS ON SEMI-FINISHED DEVICES, IN PARTICULAR FOR PRODUCING DISPOSABLE CARTRIDGES FOR ELECTRONIC CIGARETTES

CROSS-REFERENCE TO RELATED APPLICATIONS

This application is a 371 National Stage of International Application No. PCT/IB2019/057922, filed Sep. 19, 2019, which claims priority to Italian Patent Application No. 102018000009193 filed Oct. 5, 2018. The disclosure of each of the above applications is incorporated herein by reference in its entirety.

FIELD OF THE INVENTION

The present invention relates to an apparatus and a method for carrying out operations on semi-finished devices.

The invention was developed in particular for producing disposable cartridges for electronic cigarettes. However, the invention is not limited to this specific field of use and can be adopted in all cases in which it is necessary to automatically carry out operations of different types on semi-finished devices that advance along a forming path. For example, the invention can be used for producing aerosol generators in the pharmaceutical sector. Below, specific reference will be made to electronic cigarettes, without loss of generality.

DESCRIPTION OF THE PRIOR ART

A disposable cartridge for electronic cigarettes may comprise a tank intended to be filled with a liquid substance containing nicotine and possible aromas, a flow tube extending through the tank, a mouthpiece applied to a first end of the tank, a vaporizer member applied to a second end of the tank and including an electrical resistance connected to two electrical terminals and a wick arranged around the electric resistance and intended to be impregnated with the liquid substance contained in the tank.

Until recently, disposable cartridges for electronic cigarettes have been mostly produced manually or with rudimentary devices that require high manpower.

Recently, there has been a growing interest in automatic devices for the assembly, filling and capping of cartridges for electronic cigarettes. However, there are numerous problems associated with developing these devices, including the need to: guarantee a high level of quality, ensure high production rates, provide a reduced use of manpower and reduced maintenance interventions.

The document IT102016000108303 by the same Applicant describes an apparatus for producing disposable cartridges for electronic cigarettes including a plurality of operating stations spaced apart from each other along a forming path, each of which is configured to assemble a specific component of the cartridge. The apparatus comprises a closed-loop guide and a plurality of carriages movable along the guide, each of which is provided with wheels that engage rolling surfaces of the guide. The apparatus comprises a linear motor for advancing the carriages along the forming path through the various assembly stations.

During development of devices of this type, it has been found that carriages of magnetic induction linear motors are often not suitable to withstand non-barycentric loads. On the other hand, an arrangement of assembly stations in an eccentric position with respect to a middle plane of the guide is often imposed by ergonomics and machine layout considerations.

The eccentric arrangement of the operating stations with respect to the guide means that the forces that develop during the operations performed on the devices, such as during the operations of assembly, filling and capping of the cartridges, generate forces on the semi-finished devices that are discharged on the carriages. It has been noticed that these eccentric forces lead to a rapid deterioration of the wheels of the carriages, which can lead to the breaking of the wheels with consequent risk of blocking and loss of efficiency of the machine.

In current solutions, to limit this problem, the carriages are replaced during scheduled maintenance operations before they degenerate to breaking point. This involves frequent maintenance interventions and a considerable impact on the costs and productivity of the machine.

OBJECT AND SUMMARY OF THE INVENTION

The present invention aims to provide an apparatus and a method for carrying out operations on semi-finished devices, which overcome the problems of the prior art.

According to the present invention, this object is achieved, by an apparatus and a method having the characteristics forming the subject of claims 1 and 10.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

In the following description various specific details are illustrated aimed at a thorough understanding of the embodiments. The embodiments may be implemented without one or more of the specific details, or with other methods, components, or materials, etc. The reference to "an embodiment" in the context of the present description indicates that a particular configuration, structure or characteristic described in relation to the embodiment is included in at least one embodiment. Thus, phrases such as "in an embodiment", which may be present at various points in the present description do not necessarily refer to exactly the same embodiment. Moreover, particular configurations, structures or characteristics can be combined in any suitable way in one or more embodiments.

The references used here are only for convenience and do not therefore define the field of protection or the scope of the embodiments.

Figure 1:
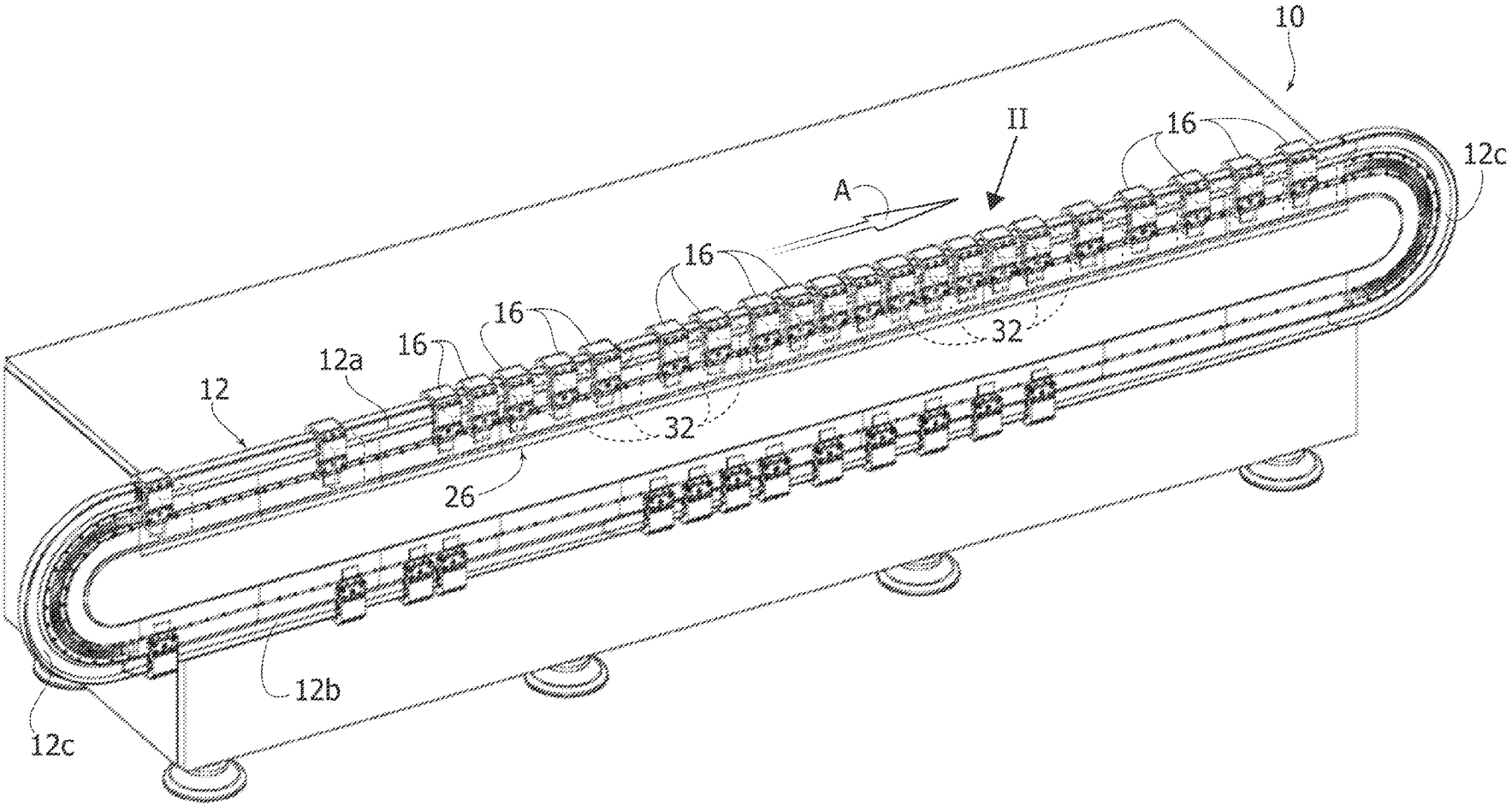
FIG. 1 is a perspective view of an apparatus according to the present invention.

In FIG. 1, numeral 10 indicates an apparatus for performing operations on semi-finished devices. In particular, the apparatus 10 can be configured to assemble, fill and cap disposable cartridges for electronic cigarettes.

The apparatus 10 comprises a guide 12 having a branch 12*a* which extends along a forming direction A. The guide 12 may be a closed-loop, as in the illustrated example. For example, the guide 12 may have two parallel straight branches 12*a*, 12*b* connected together by two arched sections 12*c*. The two straight branches 12*a*, 12*b* may be superimposed on each other in a vertical plane, as in the example shown in FIG. 1, or they can be contained in a horizontal or oblique plane. Depending on the applications, the branch 12*a* of the guide 12 may extend along a path including one or more curved or inclined sections.

Figure 3:
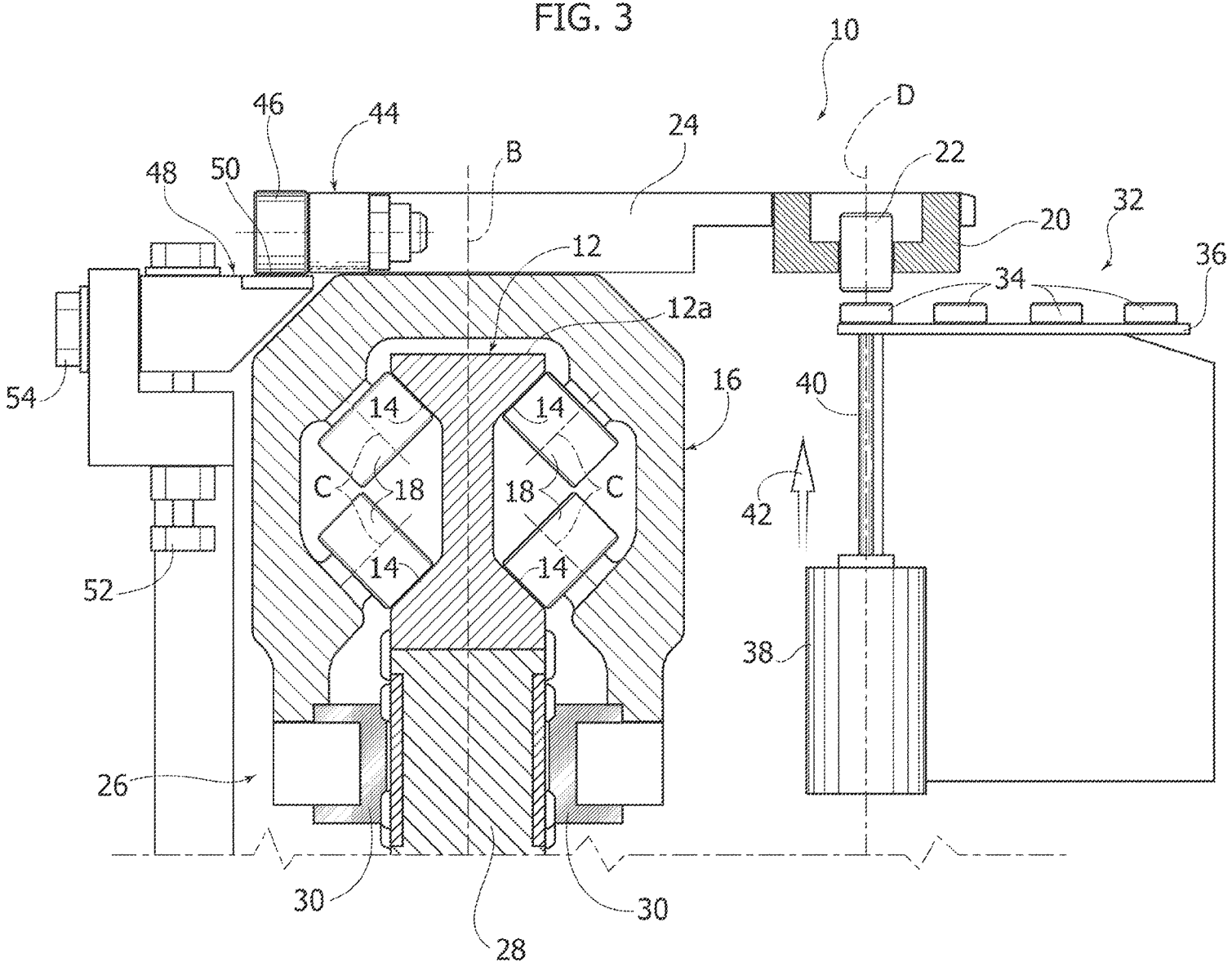
FIG. 3 is a cross-section along the line of FIG. 2.

With reference to FIG. 3, the guide 12 has at least two rolling surfaces 14 arranged symmetrically with respect to a longitudinal plane B. In the illustrated embodiment, the guide 12 has a generally I-shaped cross-section and has two pairs of rolling surfaces 14 that are symmetrical with respect to the longitudinal plane B. In cross-section, the rolling surfaces 14 can be inclined with respect to the longitudinal plane, according to a general double-Y configuration.

Figure 2:
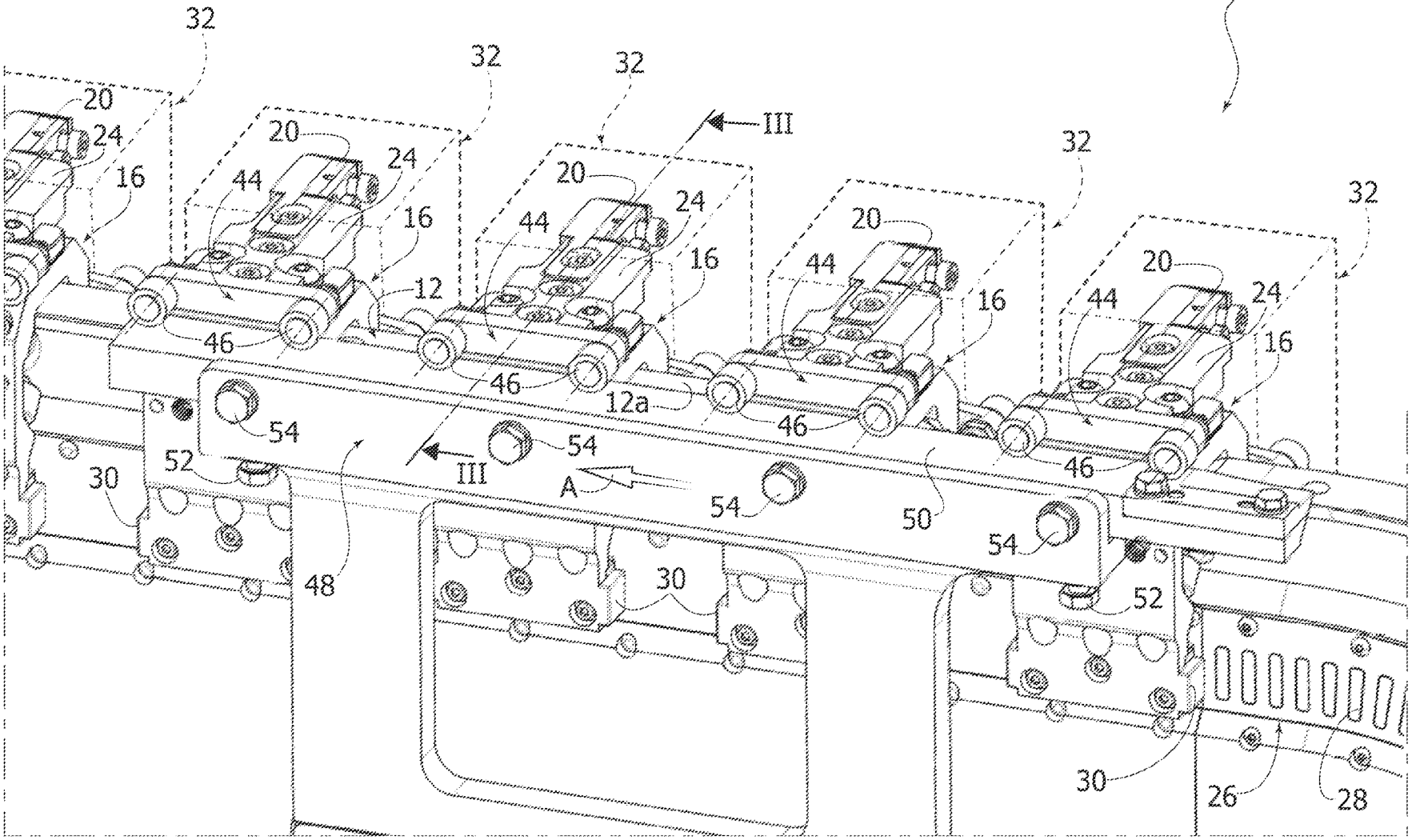
FIG. 2 is a perspective view on a larger scale of the part indicated by the arrow II in FIG. 1.

With reference to FIGS. 1-3, the apparatus 10 comprises a plurality of carriages 16 movable along the guide 12. Each carriage 16 comprises at least two wheels 18 which engage respective rolling surfaces 14 of the guide 12. In the illustrated example, each carriage 16 carries four wheels 18 that engage respective rolling surfaces 14 of the guide 12. The wheels 18 are freely rotatable about respective axes C parallel to the rolling surfaces 14.

Still with reference to FIG. 3, each carriage 16 carries a retaining element 20 configured to hold a respective semi-finished device 22 during the execution of operations thereon. The retaining element 20 may be carried by the respective carriage 16 by means of a support 24. For example, the retaining element 20 may be fixed to a support 24 which is in turn fixed to the respective carriage 16.

The retaining element 20 extends laterally from the respective carriage 16 and is displaced laterally with respect to the longitudinal plane B of the guide 12. The retaining element 20 can be made in various ways depending on the semi-finished device 22 to be retained. For example, the retaining element 20 can be made in the form of a caliper, or it can have a seat in which the semi-finished device 22 can be retained by interference. The retaining element 20 may be fixed to a support 24 that is fixed to the respective carriage 16.

The apparatus 10 comprises a drive system 26 for advancing the carriages 16 along the guide 12. In one embodiment, the drive system 26 is made in the form of a linear motor including a stator 28 fixed with respect to the guide 12, and a plurality of permanent magnets 30 carried by the carriages 16. The stator 28 can be controlled to advance the carriages 16 along the guide 12 independently from each other, for example, with different speeds and accelerations depending on the position of the carriages along the guide 12. This allows, for example, stopping one or more carriages 16 in a selected position while the remaining carriages continue to move along the guide 12.

With reference to FIGS. 1-3, the apparatus 10 comprises a plurality of operating stations 32. The operating stations 32 are displaced laterally with respect to the longitudinal plane B of the guide 12 and are spaced apart from each other in the forming direction A.

With reference to FIG. 2, each operating station 32 is configured to perform specific operations on semi-finished devices 22 carried by the retaining elements 20 of the carriages 16, for example, to assemble a specific component 34 on a semi-finished device or to perform filling or capping operations of the semi-finished products 22. The components 34 can be fed to the respective operating stations 32 by means of feeding guides 36 which carry the components 34 up to an assembly position. The component 34 located in the assembly position of the operating station 32 may be aligned along an axis D with the semi-finished device 22, which—in each case—is located at the operating station 32.

The operating stations 32 can be configured differently depending on the type of operation they need to perform, for example, depending on the type of component 34 that they intend to assemble. For example, one or more of the operating stations 32 may comprise a linear actuator 38 having a stem 40 movable in a direction 42 for assembling the component 34—located in the assembly position—on the semi-finished device 22, which is positioned, in each case, in the operating station 32.

The position of the operating stations 32 is not barycentric with respect to the guide 12, or rather it is displaced laterally with respect to the longitudinal plane B of the guide 12; the position is often imposed by ergonomics and installation layout considerations. In the case where the operating station 32 is a filling station that fills the semi-finished devices with a liquid, the arrangement of the operating station 32—displaced laterally with respect to the longitudinal plane B of the guide 12—also has the advantage that any dripping of liquid product does not dirty the handling system.

The non-barycentric arrangement of the operating stations 32 produces torsional torques acting on the carriages 16, due to the eccentric forces generated during operations on the semi-finished devices 22. These torsional torques tend to generate stresses on the wheels 18 of the carriages 16, which could lead to premature wear of the carriages themselves.

According to the present invention, to overcome this drawback the carriages 16 comprise respective contrast elements 44 arranged so as to counterbalance the forces applied by the operating means of the operating stations 32 on the semi-finished devices 22 carried by the retaining elements 20 of the carriages 16.

Figure 4:
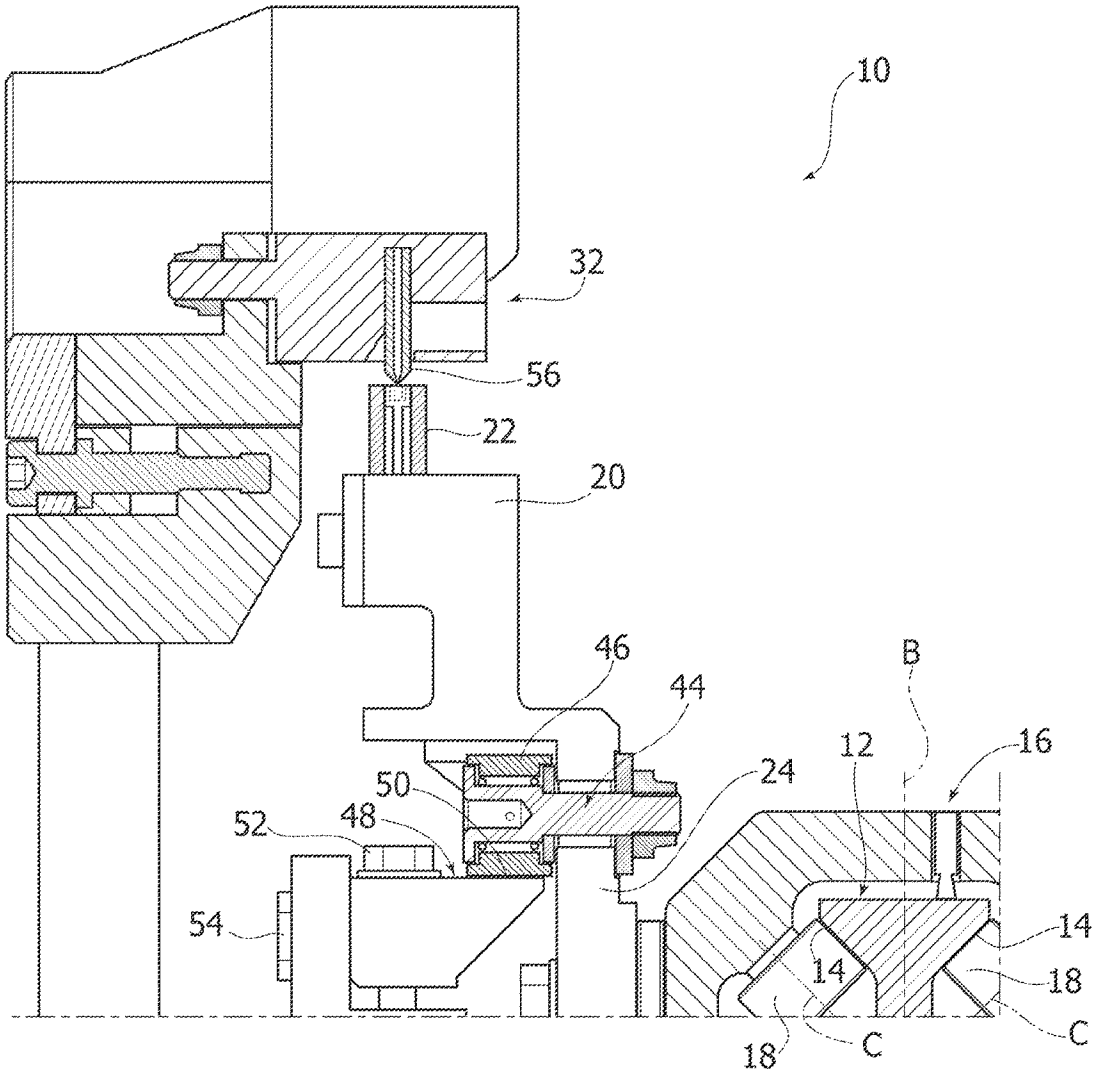
FIG. 4 is a cross-section similar to FIG. 3 illustrating an alternative embodiment.

With reference to FIGS. 2, 3 and 4, the apparatus 10 comprises a stationary support 48 fixed to the stationary frame of the apparatus 10. The contrast elements 44 of the carriages 16 cooperate with the stationary support 48 to transfer the torques generated by the operating means at the operating stations 32, during operations on the semi-finished devices 22, onto the stationary support 48.

In one embodiment, the contrast element 44 comprises at least one wheel 46 rotatable about an axis perpendicular to the longitudinal plane B of the guide 12. In a preferred embodiment, the contrast element 44 can be fixed to the same support 24 that carries the retaining element 20. In this way, the solution is constructively simplified. In one or more embodiments, the contrast element 44 may comprise two wheels 46 rotatable about respective axes spaced apart from each other along a direction parallel to the longitudinal plane B.

In one embodiment, the stationary support 48 comprises at least one rolling surface 50 on which at least one wheel 46 of the contrast element 44 rests. In one embodiment, the position of the stationary support 48 with respect to the guide 12 can be adjustable, for example, by means of adjusting screws 52, 54, which may allow adjustment of the position of the rolling surface 50 along a direction parallel to the longitudinal plane B and along a direction perpendicular to the longitudinal plane B.

The stationary support 48 may be located only at the operating stations 32 or may extend continuously along the branch 12*a* of the guide 12. The solution illustrated in FIG.

2, in which the stationary support 48 extends only at the operating stations 32, is advantageous from the point of view of the overall dimensions of the apparatus 10, which are smaller, and from the practical point of view, since they allow greater accessibility to the device 10 by an operator.

In the embodiment illustrated in FIGS. 2 and 3, the stationary support 48 is located on the opposite side of the retaining element 20 with respect to the longitudinal plane B. The contrast element 44 and the stationary support 48 are arranged so as to discharge the torsional torque produced by the forces generated on the semi-finished devices 22 by the operating stations 32 onto the stationary support 48.

In an alternative embodiment illustrated in FIG. 4, the stationary support 48 is located on the same side as the retaining element 20 with respect to the longitudinal plane B. In the example of FIG. 4, the operating station 32 can be a filling station provided with a nozzle 56 which fills the semi-finished devices 22, carried by the carriages 16, with a liquid.

In both arrangements, the force applied by the operating means 40, 56 of the operating stations 32 on the semi-finished devices 22 is counterbalanced by a force applied by the contrasting element 44 to the stationary support 48, without stressing the wheels 18 of the carriages 16. In this way, no overload is generated on the wheels 18 of the carriages 16, and an early deterioration of the carriages is avoided.

It is understood that the fact of equipping the carriages 16 with respective contrast elements 44 cooperating with a stationary support 48 prevents eccentric forces (with respect to the longitudinal plane B) from creating stresses on the wheels 18 of the carriages 16. In particular, the contrast element 44 can be fixed directly to the support 24 that carries the retaining element 20 so that the torque generated by the operating stations 32 is discharged onto the stationary support 48 before generating any stress on the wheels 18 of the carriages 16.

One or more embodiments may relate to a machine for producing cartridges for electronic cigarettes comprising an apparatus 10, including at least one assembly station configured to assemble at least one component 34 on a semi-finished cartridge 22, a filling station configured to fill the semi-finished cartridge with a liquid, and a capping station to apply a cap to the cartridge downstream of the filling station. In one or more embodiments assembly, filling and capping operations have the possibility of not being carried out on the same line, so that semi-finished cartridges could, for example, be assembled on a first device and could be filled and capped on a different device.

Of course, without prejudice to the principle of the invention, the details of construction and the embodiments can be widely varied with respect to those described and illustrated, without thereby departing from the scope of the invention as defined by the claims that follow.

The invention claimed is:

1. An apparatus for carrying out operations on semi-finished devices, comprising:

a guide having a branch extending along a forming direction, wherein said guide has a longitudinal plane and at least two rolling surfaces symmetrically arranged with respect to said longitudinal plane, a plurality of carriages movable along said guide, each of which comprises at least two wheels which engage respective rolling surfaces, wherein each of said plurality of carriages comprises a retaining element to retain a respective semi-finished device during the-execution of the operations thereon, a drive system for advancing said plurality of carriages along said guide, and a plurality of operating stations spaced apart from each other along said forming direction each of which comprises an operating arrangement configured to perform specific operations on semi-finished devices carried by said retaining elements of the plurality of carriages, applying stresses on said semi-finished devices, wherein the retaining element of each carriage is arranged laterally with respect to said longitudinal plane of said guide, and wherein the apparatus comprises at least one stationary support located at least at said plurality of operating stations, and in that each of said carriages comprises a respective contrast element cooperating with said at least one stationary support and arranged to transfer the stresses applied by said operating arrangement on said semi-finished devices to said at least one stationary support.

2. The apparatus according to claim 1, wherein said stationary support is located on the opposite side of said retaining element with respect to said longitudinal plane.

3. The apparatus according to claim 1, wherein said stationary support is located on the same side of said retaining element with respect to said longitudinal plane.

4. The apparatus according to any one of the claim 1, wherein the retaining element and the contrast element of each carriage are carried by a common support fixed to the carriage.

5. The apparatus according to claim 1, wherein each contrast element comprises at least one wheel rotatable about a respective axis perpendicular to said longitudinal plane.

6. The apparatus according to claim 5, wherein each contrast element comprises at least two wheels rotatable about respective axes spaced apart along a direction parallel to said longitudinal plane.

7. The apparatus according to claim 5, wherein said stationary support comprises a rolling surface on which the wheels of said contrast elements roll during the movement of the carriages along said forming direction.

8. The apparatus according to claim 1, wherein said drive system comprises a linear motor comprising a stator fixed to said guide, and a plurality of permanent magnets carried by said carriages.

9. A machine for producing cartridges for electronic cigarettes comprising an apparatus according to claim 1, including at least one assembly station configured to assemble at least one component on a semi-finished cartridge, a filling station configured to fill the semi-finished cartridge with a liquid and a capping station to apply a cap to the cartridge downstream of the filling station.

10. A method for carrying out operations on semi-finished devices, comprising:

providing a guide having a branch extending along a forming direction, wherein said guide has a longitudinal plane and is provided with at least two rolling surfaces symmetrically arranged with respect to said longitudinal plane, advancing a plurality of carriages along said guide, wherein each of said plurality of carriages comprises at least two wheels which engage respective rolling surfaces wherein each of said plurality of carriages carries a retaining element which retains a respective semi-finished device during execution of the operations thereon, providing a plurality of operating stations each of which comprises an operating arrangement that performs specific operations on the semi-finished devices carried by said retaining elements of the plurality of carriages applying stresses on said semi-finished devices, wherein the retaining element of each carriage is arranged laterally with respect to said longitudinal plane of said guide, wherein the apparatus comprises at least one stationary support located at least at said plurality of operating stations, and in that each of said carriages comprises a respective contrast element cooperating with said at least one stationary support and arranged to transfer the stresses applied by said operating arrangement on said semi-finished devices to said at least one stationary support.

11. The method according to claim 10, wherein advancing said plurality of carriages along said guide is controlled by a linear motor comprising a stator fixed to said guide, and a plurality of permanent magnets carried by said carriages.

12. The method according to claim 10, wherein said contrast element comprises at least one wheel which rolls on a rolling surface of said at least one stationary support.

13. The method according to claim 10, wherein the stresses applied by said operating means on said semi-finished devices are discharged by said contrast elements onto said stationary support without stressing said wheels of said carriages.

14. A method for producing cartridges for electronic cigarettes according to claim 10, wherein said semi-finished devices are semi-finished cartridges for electronic cigarettes, the method comprising:

assembling at least one component on a semi-finished cartridge, filling the semi-finished cartridge with a liquid, and capping the semi-finished cartridge after filling.

* * * * *